US006933901B2

(12) United States Patent
Pawlenko et al.

(10) Patent No.: US 6,933,901 B2
(45) Date of Patent: Aug. 23, 2005

(54) ANTENNA ALIGNMENT USING A TEMPERATURE-DEPENDENT DRIVER

(75) Inventors: Ivan Pawlenko, Holland, PA (US); Larry Samson, Langhorne, PA (US); Richard F. Schwartz, Cranbury, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 86 days.

(21) Appl. No.: 10/389,067

(22) Filed: Mar. 14, 2003

(65) Prior Publication Data

US 2004/0178963 A1 Sep. 16, 2004

(51) Int. Cl.[7] ..... H01Q 3/00; H01Q 1/12

(52) U.S. Cl. ..... 343/757; 343/758; 343/878; 342/359

(58) Field of Search ..... 343/757, 754, 343/760, 878, 882, 758; 342/359; H01Q 3/00, 1/12

(56) References Cited

U.S. PATENT DOCUMENTS 5,515,058 A 5/1996 Chaney et al. ..... 343/760
5,576,722 A 11/1996 Bustillos ..... 343/882
6,175,989 B1 * 1/2001 Carpenter et al. ..... 16/225
6,366,253 B1 4/2002 Hemmingsen, II ..... 343/760
6,434,333 B2 * 8/2002 Tanaka et al. ..... 396/132
2002/0114108 A1 * 8/2002 Bement et al. ..... 360/245.4
2004/0085615 A1 * 5/2004 Hill et al. ..... 359/288

* cited by examiner

*Primary Examiner*—Trinh Vo Dinh

(57) ABSTRACT

A system having a steerable antenna coupled to a temperature-dependent driver. The driver has a shape-memory element fabricated using a shape-memory alloy (SMA) and having the ability to change its shape as a function of temperature. The element is adapted to steer the antenna to improve signal reception and is controlled by a control circuit, which resistively heats the element while using the strength of the electrical signal generated by the antenna in response to a received radio-frequency signal as a feedback signal. The temperature of the element is adjusted to optimize the signal strength. Systems of the invention may enable customer-performed antenna alignment and are relatively simple and inexpensive to implement.

22 Claims, 8 Drawing Sheets

ANTENNA ALIGNMENT USING A TEMPERATURE-DEPENDENT DRIVER

BACKGROUND OF THE INVENTION

1. Field of the Invention

The present invention relates to wireless communication equipment.

2. Description of the Related Art

Medium-size (e.g., 10–50 cm) radio antennas are often used for wireless communication and various broadband applications. Such an antenna may be installed outside (e.g., on the roof) of a home or commercial building. During installation, the antenna is typically aligned, e.g., by manually pointing the antenna, for optimal signal strength. The antenna is then fixed in an optimal orientation. Special equipment and a qualified technician are often needed to properly align the antenna. In addition, it is not unusual that the alignment of the antenna needs to be adjusted weeks or months after the installation. This typically occurs due to changes in the surroundings (e.g., a new building) and/or changes in the network configuration (e.g., an added or moved base station).

SUMMARY OF THE INVENTION

Problems in the prior art are addressed in accordance with the principles of the present invention by a system having a steerable antenna coupled to a temperature-dependent driver. The driver has a shape-memory element fabricated using a shape-memory alloy (SMA) and having the ability to change its shape as a function of temperature. The element is adapted to steer the antenna to improve signal reception and is controlled by a control circuit, which resistively heats the element while using the strength of the electrical signal generated by the antenna in response to a received radio-frequency signal as a feedback signal. The temperature of the element is adjusted to optimize the signal strength. Systems of the invention may enable customer-performed antenna alignment and are relatively simple and inexpensive to implement.

According to one embodiment, the present invention is an apparatus for controlling orientation of an antenna, comprising: a shape-memory element mechanically coupled between the antenna and a mounting structure; and a control circuit electrically coupled to the shape-memory element, wherein: the control circuit is designed to control temperature of the shape-memory element; and in response to a change in the temperature, the shape-memory element changes shape, which changes the orientation of the antenna relative to the mounting structure.

According to another embodiment, the present invention is a communication system, comprising: a steerable antenna; a shape-memory element mechanically coupled between the antenna and a mounting structure; and a control circuit electrically coupled to the shape-memory element, wherein: the control circuit is designed to control temperature of the shape-memory element; and in response to a change in the temperature, the shape-memory element changes shape, which changes the orientation of the antenna relative to the mounting structure.

According to yet another embodiment, the present invention is a method of controlling orientation of an antenna, comprising changing temperature of a shape-memory element, wherein: the shape-memory element is mechanically coupled between the antenna and a mounting structure; and in response to a change in the temperature, the shape-memory element changes shape, which changes the orientation of the antenna relative to the mounting structure.

BRIEF DESCRIPTION OF THE DRAWINGS

Other aspects, features, and benefits of the present invention will become more fully apparent from the following detailed description, the appended claims, and the accompanying drawings in which:

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Figure 1:
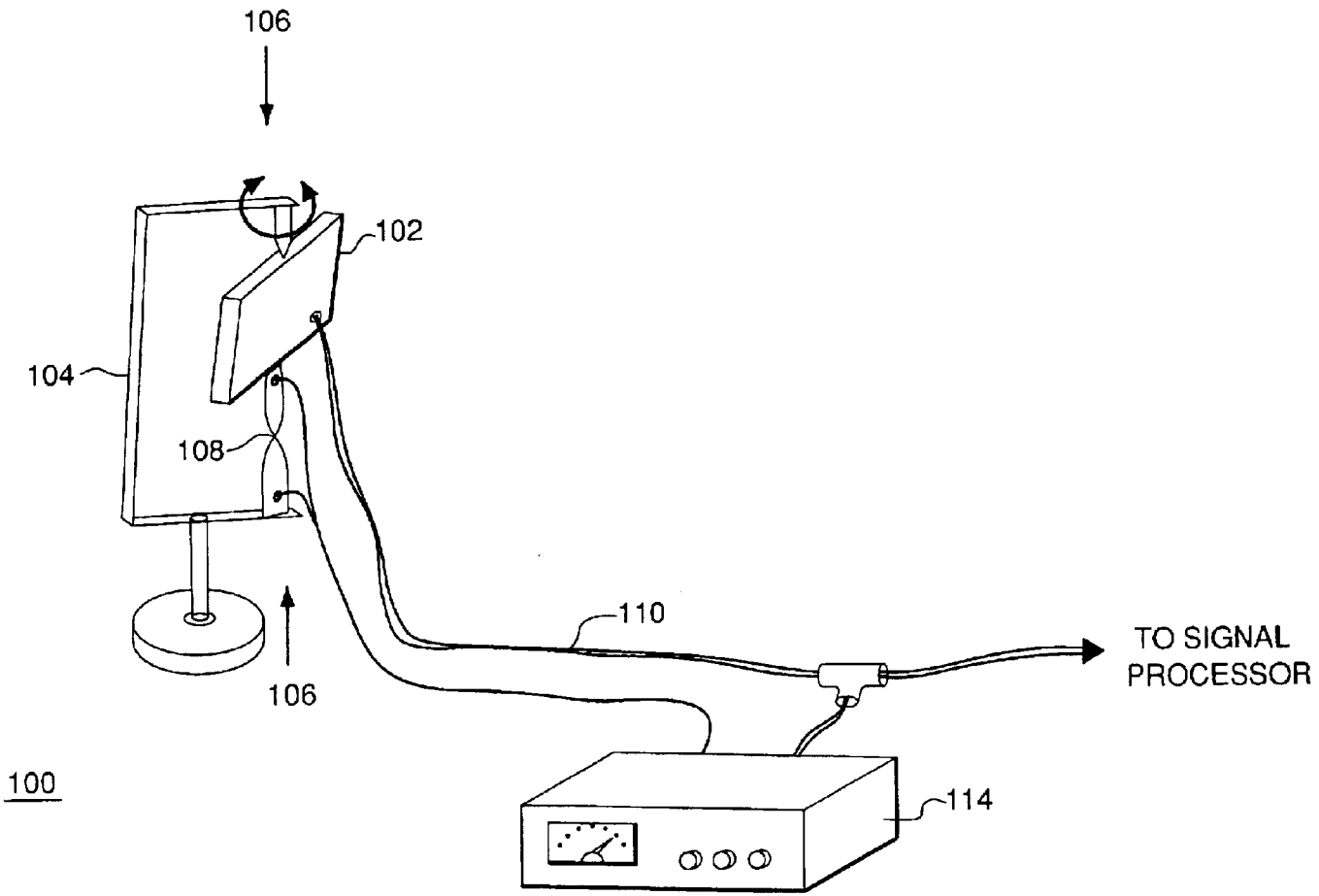
FIG. 1 shows a three-dimensional perspective view of a representative communication system according to one embodiment of the present invention.

FIG. 1 shows a three-dimensional perspective view of a representative communication system 100 according to one embodiment of the present invention. System 100 includes a steerable antenna 102 rotatably mounted on a frame 104 and connected to a signal processor (e.g., a local area network transceiver, not shown) by a cable 110. Antenna 102 is coupled to a temperature-dependent driver 106, which is configured to rotate the antenna about a vertical axis as indicated by the double-headed arrow in FIG. 1. The angle of rotation (i.e., the azimuth angle) is determined by the temperature of a shape-memory element 108 in driver 106, the principle of operation of which will be described in more detail below. The temperature of shape-memory element 108 is controlled by a control circuit 114, which resistively heats the element by passing current through it while using the strength of the signal received from antenna 102 as a feedback signal. Circuit 114 is designed to control the azimuth angle of antenna 102 to increase the signal strength by adjusting the current passing through element 108.

Figure 2:
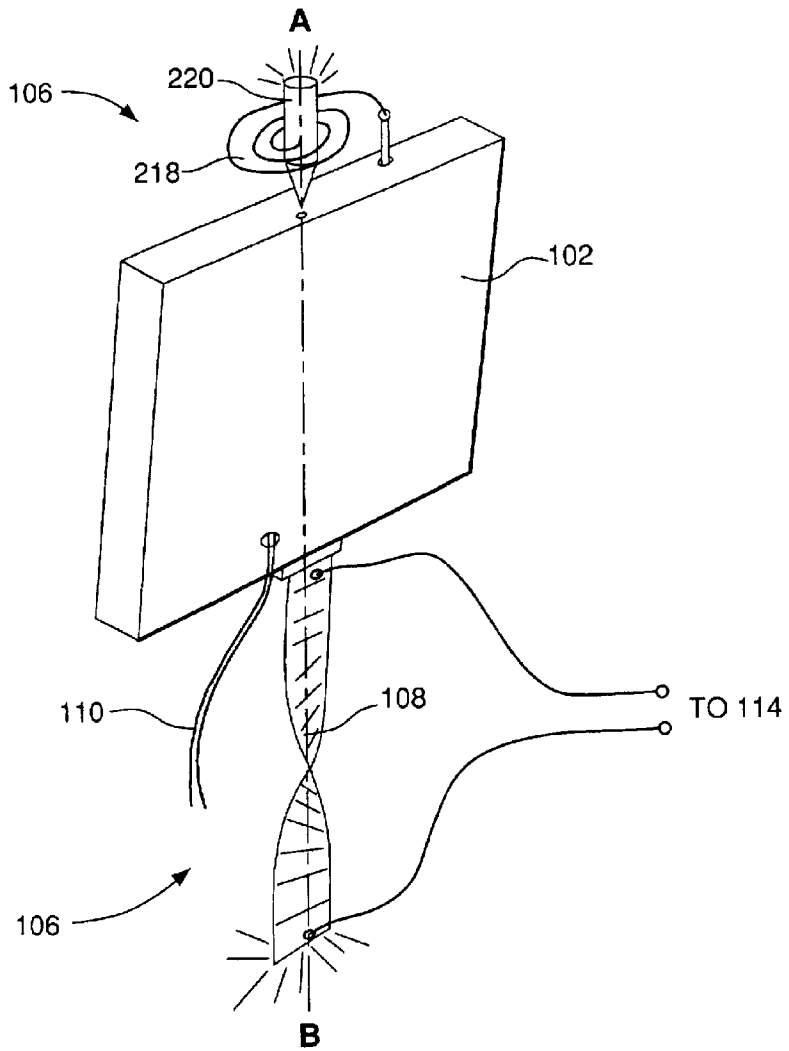
FIG. 2 shows an enlarged perspective view of the driver/antenna assembly used in the system of FIG. 1.

FIG. 2 shows an enlarged perspective view of the driver/antenna (106/102) assembly in system 100 of FIG. 1. Driver 106 is configured to rotate antenna 102 about axis AB and includes shape-memory element 108, a bias spring 218, and a pivot 220. Shape-memory element 108 is a twisting strip-element connected between frame 104 (FIG. 1) and antenna 102. Bias spring 218 is a helical spring connected between pivot 220 (which is rigidly connected to frame 104) and antenna 102 and configured to oppose the shape-restoring force generated by shape-memory element 108. As a result, antenna 102 adopts an orientation in which the forces generated by element 108 and spring 218 compensate each other. In one embodiment, driver 106 includes an orientation-locking mechanism (not shown), e.g., a friction lock, that can be engaged to lock antenna 102 in position, e.g., to fix the antenna at a present azimuth angle. Control circuit 114 may include appropriate circuitry for controlling (i.e., engaging/disengaging) the orientation-locking mechanism.

In one embodiment, shape-memory element 108 is fabricated using a shape-memory alloy (SMA), e.g., a nickel titanium alloy, available from Shape Memory Applications, Inc., of San Jose, Calif. SMA alloys belong to a group of materials characterized by the ability to return to a predetermined shape when heated. This ability is usually referred to as a shape-memory effect. The shape-memory effect occurs due to a phase transition in the SMA alloy between a weaker low-temperature (Martensite) phase and a stronger high-temperature (Austenite) phase. When an SMA alloy is in its Martensite phase, it is relatively easily deformed into a new shape. However, when the alloy is heated and transformed into its Austenite phase, it recovers its initial shape with relatively great force.

The Martensite/Austenite phase transition occurs over a temperature range, within which the two phases coexist. Within this transition temperature range, the phase ratio and therefore the shape-restoring force generated by a shape-memory element are functions of temperature. In addition, the Martensite/Austenite phase transition exhibits a hysteresis, that is, the phase ratio and the force are functions of the transition direction, i.e., Martensite to Austenite or Austenite to Martensite. The upper and lower temperature bounds of the transition temperature range can themselves depend on the transition direction. For example, a first set of temperature bounds may characterize the Martensite-to-Austenite transition while a second set of temperature bounds, different from the first set, characterizes the Austenite-to-Martensite transition. The upper and lower temperature bounds can be selected during manufacture of the SMA alloy, e.g., based on the SMA composition and/or special heat treatment. In one implementation, shape-memory element 108 is fabricated using an SMA alloy having the transition temperature range of 95° C. to 100° C. In another implementation, element 108 is fabricated such that the corresponding transition temperature range is separated from the highest expected environment temperature for element 108 by about 10 degrees.

Figure 3B:
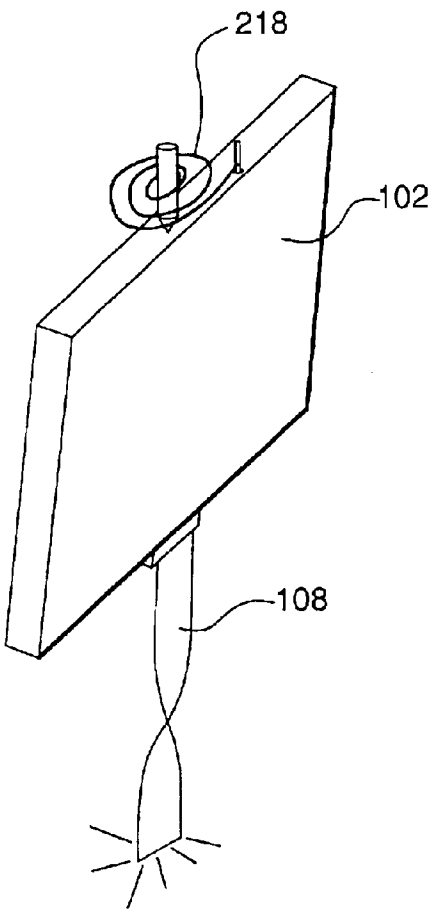
FIGS. 3A–B schematically illustrate antenna rotation in the assembly of FIG. 2.
Figure 3A:
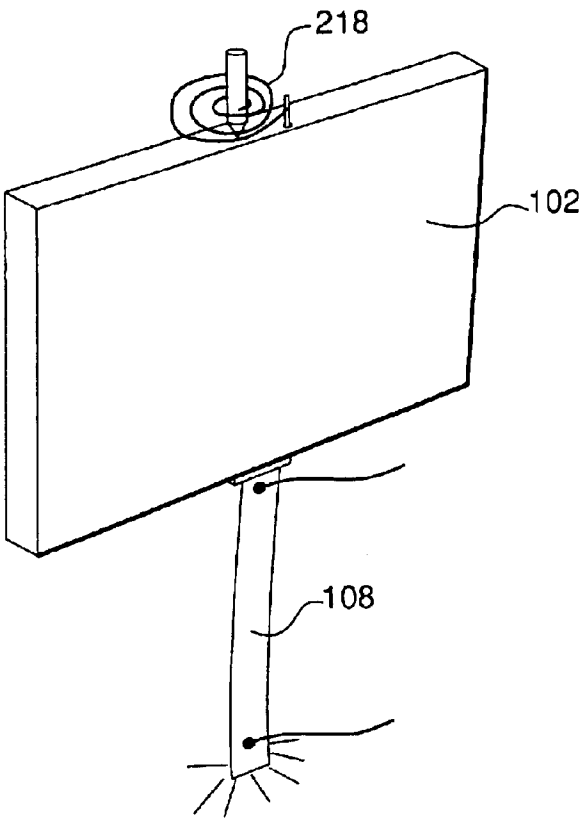

FIGS. 3A–B schematically illustrate rotation of antenna 102 by driver 106 in system 100. More specifically, FIGS. 3A–B show positions of antenna 102, when shape-memory element 108 is at temperatures below and above, respectively, the SMA transition temperature range. Shape-memory element 108 is fabricated such that it has a twisted-strip shape in its high-temperature (Austenite) phase. When the temperature of shape-memory element 108 is lowered, e.g., below the lower transition temperature bound, shape-memory element 108 is untwisted by the action of bias spring 218 as illustrated in FIG. 3A, which rotates antenna 102 clockwise as viewed from the top of FIG. 3A. Similarly, when the temperature of shape-memory element 108 is elevated, e.g., above the upper transition temperature bound, element 108 overcomes the force of bias spring 218 to return to its original twisted shape as illustrated by FIG. 3B, which rotates antenna 102 counterclockwise as viewed from the top of FIG. 3B. Intermediate rotation angles (e.g., between the angles shown in FIGS. 3A–B) can be obtained by appropriately selecting the temperature of shape-memory element 108.

The following describes a representative alignment procedure for antenna 102 (FIGS. 1–3) according to one embodiment of the present invention. When shape-memory element 108 is at a temperature below the SMA transition temperature range (e.g., ambient temperature) and the orientation-locking mechanism (not shown) is disengaged, the action of bias spring 218 deforms shape-memory element 108 and moves antenna 102 into a first terminal position, e.g., shown in FIG. 3A. Next, control circuit 114 is turned on and begins to pass current through and increase the temperature of shape-memory element 108. When the temperature reaches the lower transition temperature bound, shape-memory element 108 begins to recover its original shape and thereby rotate antenna 102 toward a second terminal position, e.g., shown in FIG. 3B, which position corresponds to the original shape of shape-memory element 108. In a preferred implementation, the second terminal position corresponds to a 360° turn of antenna 102 with respect to the first terminal position. During the rotation, control circuit 114 monitors the signal strength from antenna 102 and adjusts the temperature of shape-memory element 108 accordingly to find an azimuth angle corresponding to optimal signal reception. Control circuit 114 is preferably designed to implement one or more side-lobe avoiding techniques, as known in the art, to ascertain that antenna 102 is steered into an orientation corresponding to the main lobe and not to a side lobe. When an optimal azimuth angle is found, control circuit 114 engages the orientation-locking mechanism to fix that azimuth angle for antenna 102, after which control circuit 114 may be turned off until the antenna needs to be realigned.

Figure 4:
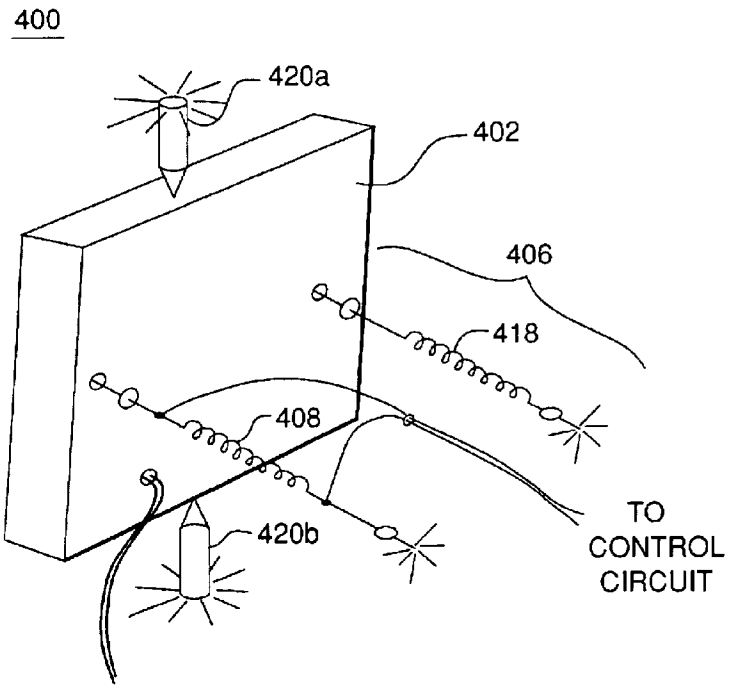
FIG. 4 schematically shows a perspective view of a driver/antenna assembly that can be used in a communication system similar to the system of FIG. 1 according to another embodiment of the present invention.

FIG. 4 schematically shows a perspective view of a driver/antenna assembly 400 that can be used in a communication system similar to system 100 of FIG. 1 according to another embodiment of the present invention. Assembly 400 includes a steerable antenna 402 mounted on two pivots 420*a–b*. Antenna 402 is coupled to a temperature-dependent driver 406 configured to rotate the antenna about the axis defined by pivots 420*a–b*. Driver 406 includes a shape-memory coil-element 408 and a bias coil-spring 418. Each of element 408 and spring 418 is connected between antenna 402 and a housing (not shown) such that the shape-restoring force generated by element 408 opposes the spring force generated by spring 418. Similar to shape-memory element 108 (FIGS. 1–3), shape-memory element 408 is fabricated using an SMA alloy and can be resistively heated, e.g., using a control circuit similar to circuit 114 of system 100.

Figure 5A:
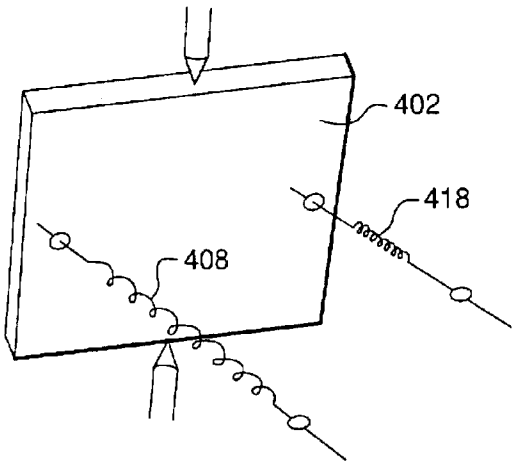
FIGS. 5A–B schematically illustrate antenna rotation in the assembly of FIG. 4.
Figure 5B:
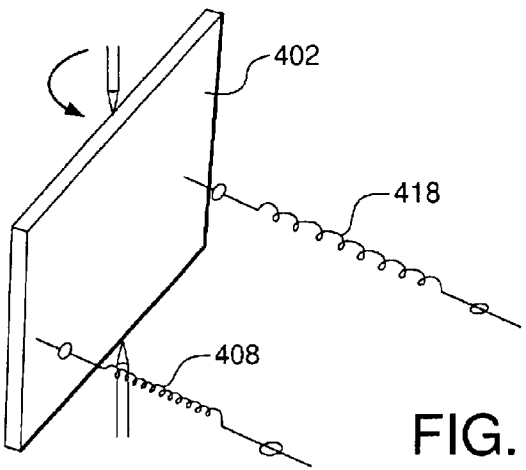

FIGS. 5A–B schematically illustrate rotation of antenna 402 using driver 406 in assembly 400. More specifically, FIGS. 5A–B show positions of antenna 402, when shape-memory element 408 is at temperatures below and above, respectively, the SMA transition-temperature range. Shape-memory element 408 is fabricated such that it has a tightly coiled shape in the high-temperature (Austenite) phase. At a low temperature illustrated by FIG. 5A, shape-memory element 408 is deformed into a loosely coiled shape by the action of bias spring 418. However, as the temperature of shape-memory element 408 is elevated, element 408 begins to recover the original tightly coiled shape due to the above-described shape-memory effect. As a result, antenna 402 will rotate counterclockwise as indicated by the arrow in FIG. 5B. Antenna 402 will return to the position shown in FIG. 5A when the temperature is lowered.

Figure 6:
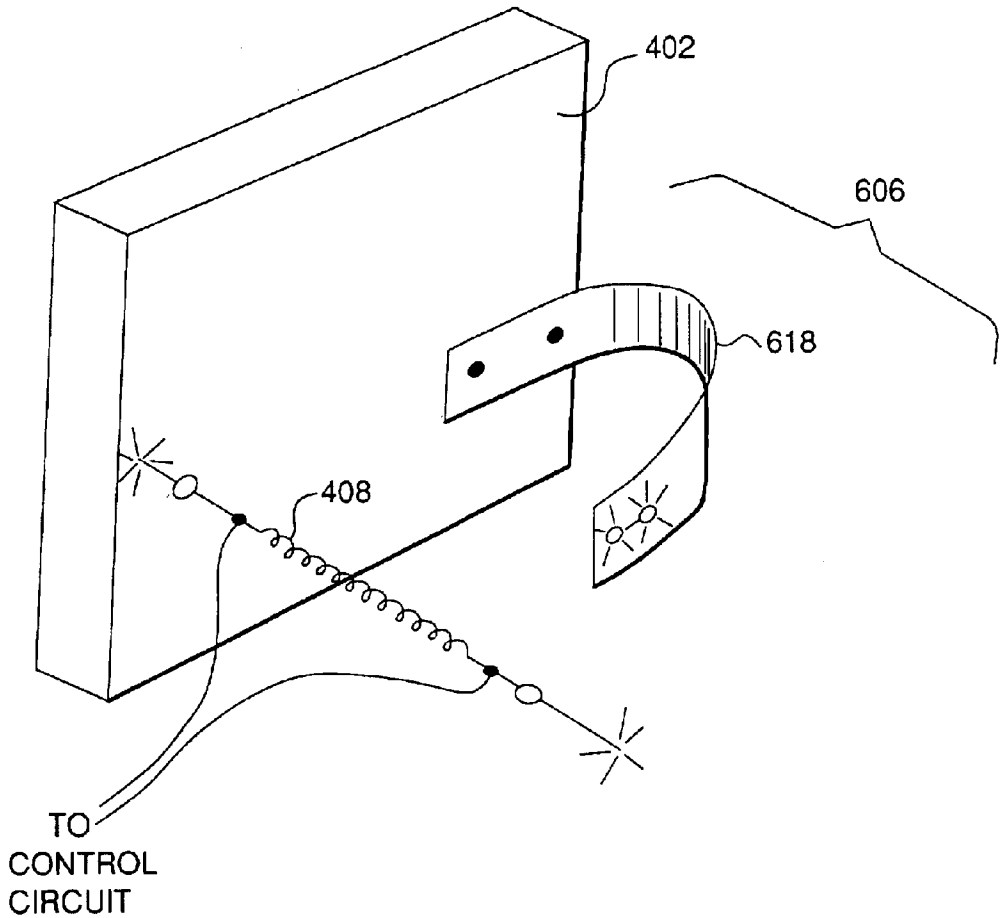
FIG. 6 schematically shows a temperature-dependent driver that can be used in the driver/antenna assembly of FIG. 4 according to another embodiment of the present invention.

FIG. 6 schematically shows a temperature-dependent driver 606 that can be used in driver/antenna assembly 400 of FIG. 4 according to another embodiment of the present invention. Driver 606 is similar to driver 406 except that, instead of coil spring 418 of driver 406, driver 606 has a U-shaped strip spring 618. As can be appreciated by one skilled in the art, in different embodiments, differently shaped and configured shape-memory elements and/or bias springs can be used.

Figures 7A, 7B:
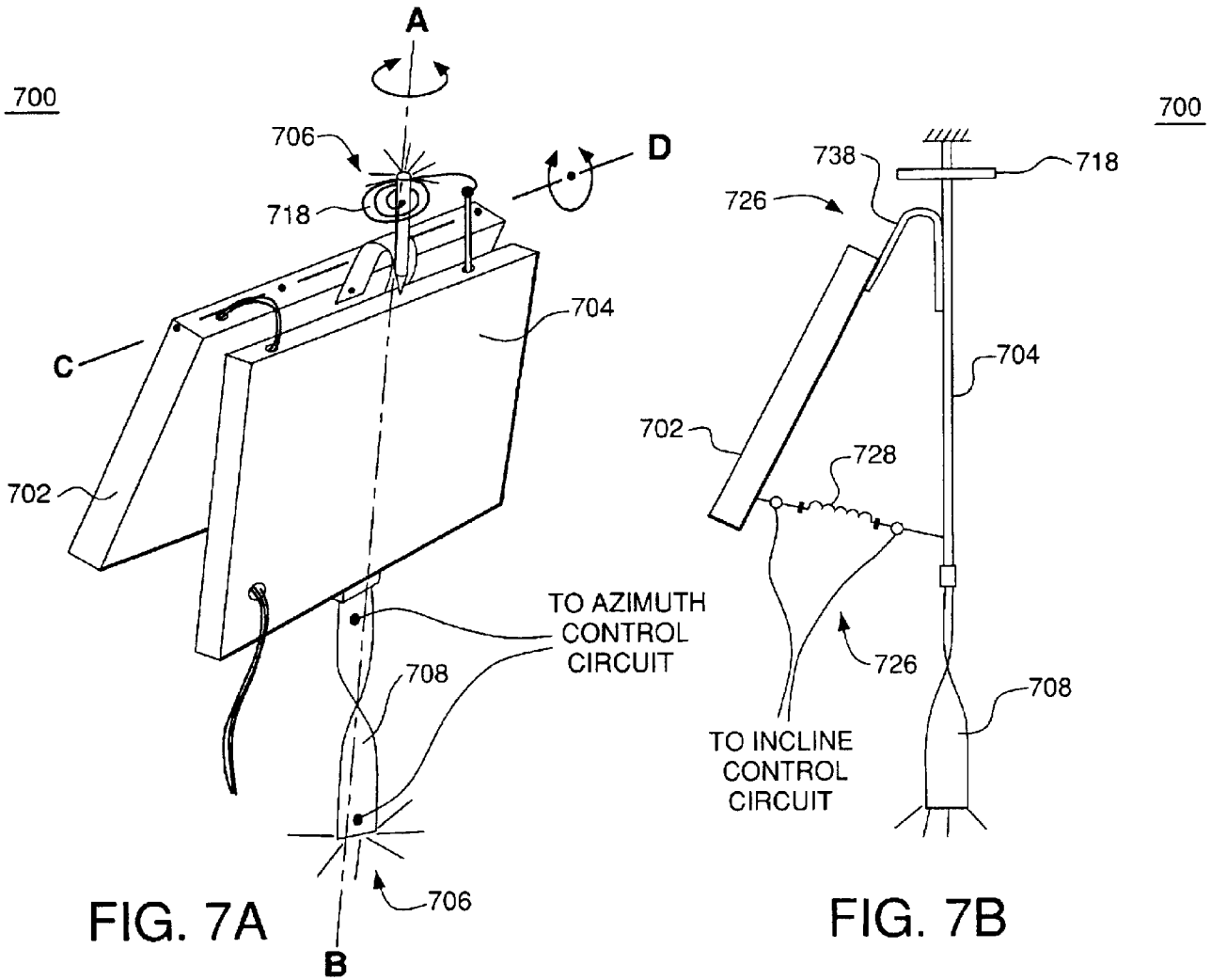
FIGS. 7A–B schematically show perspective and side views of a driver/antenna assembly that can be used in a communication system similar to the system of FIG. 1 according to yet another embodiment of the present invention.

FIGS. 7A–B schematically show a driver/antenna assembly 700 that can be used in a communication system similar to system 100 of FIG. 1 according to yet another embodiment of the present invention. More specifically, FIG. 7A shows a perspective view of assembly 700, and FIG. 7B shows a side view of that assembly. Assembly 700 is designed to provide a capability to adjust both the azimuth angle and the tilt angle of a steerable antenna 702. Antenna 702 is mounted on a movable support plate 704, which is coupled to a first temperature-dependent driver 706. Driver 706 has a shape-memory element 708 and a bias spring 718 and is similar to driver 106 of FIGS. 1–3. A second temperature-dependent driver 726 is coupled between support plate 704 and antenna 702. Driver 726 has a shape-memory element 728 and a bias spring 738 and is similar to driver 606 of FIG. 6. Driver 706 is configured to rotate support plate 704 (and therefore antenna 702) about axis AB as indicated in FIG. 7A. Similarly, driver 726 is configured to rotate antenna 702 with respect to support plate 704 about axis CD. Therefore, by independently controlling the temperatures of shape-memory elements 708 and 728, one can adjust both azimuth and tilt angles of antenna 702. In one configuration, elements 708 and 728 are controlled by a control circuit analogous to control circuit 114 of FIG. 1.

Figure 8:
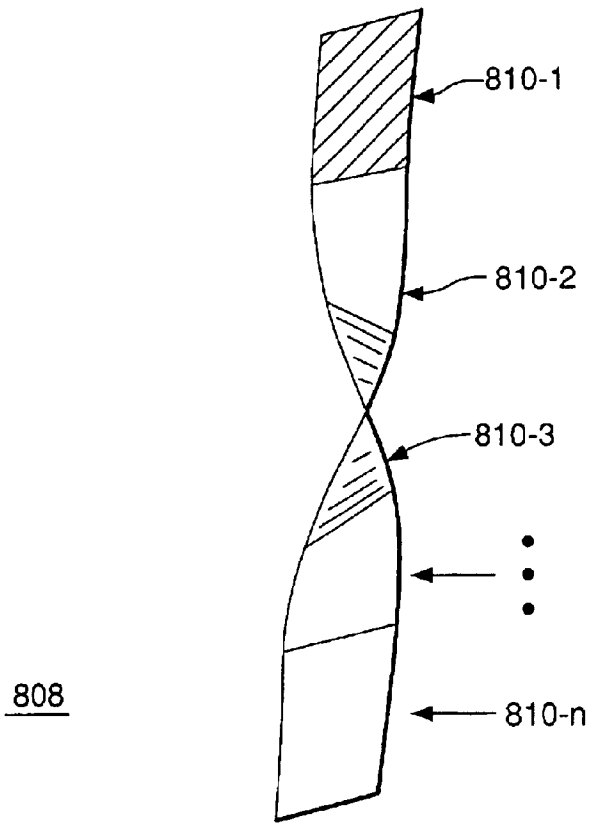

FIG. 8 schematically shows a sectional shape-memory element 808 that can be used as element 708 in antenna assembly 700 according to one embodiment of the present invention. Sectional shape-memory element 808 is a twisting strip-element comprising n sections 810-1–810-n. Each section 810 has a specific SMA composition and therefore specific properties such as, for example, the transition temperature range and value of spring constant. By appropriately choosing the SMA composition for each segment, shape-memory element 808 can be designed to have a linear temperature-force or current-force behavior. In addition or alternatively, element 808 may be designed to exhibit reduced hysteresis. Element 808 can be fabricated, for example, by mechanically fastening segments 810 together or by a controlled alloying process.

Figure 9:
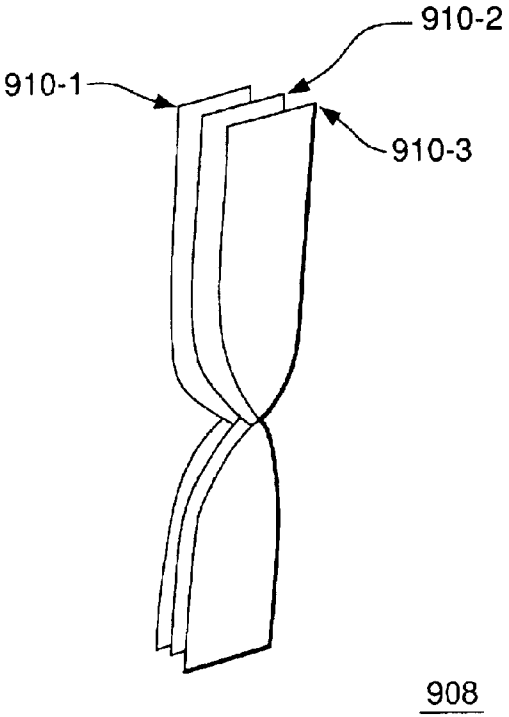
FIGS. 8–11 schematically show various shape-memory elements that can be used in the driver/antenna assembly of FIG. 7 according to certain embodiments of the present invention.
Figure 10:
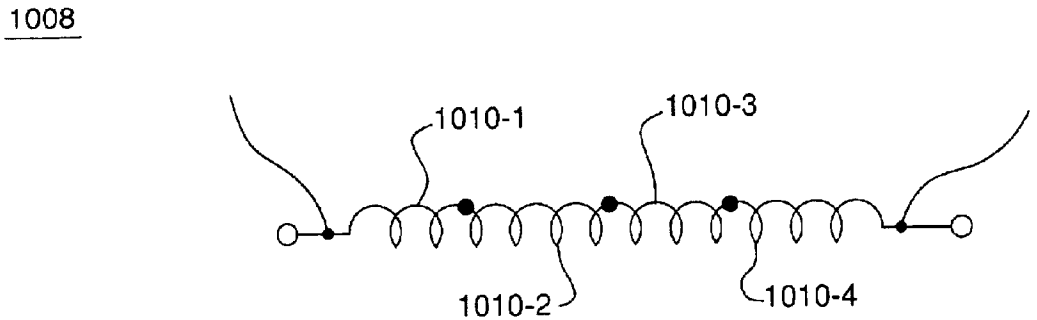
Figure 11:
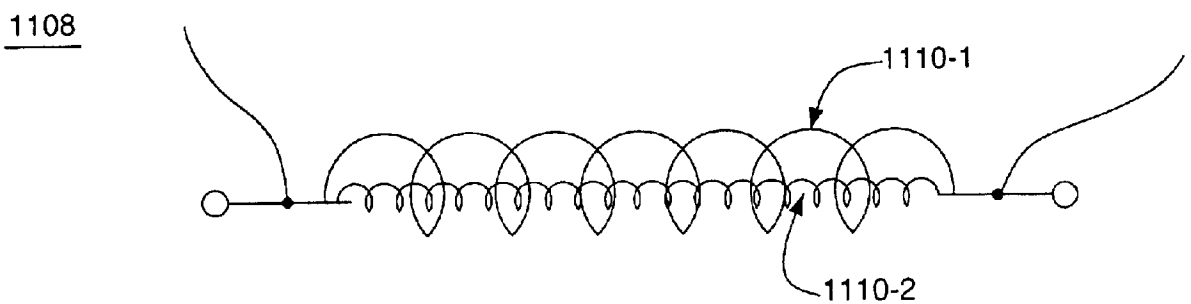

FIGS. 9–11 schematically show various shape-memory elements, each of which can be used in antenna assemblies (e.g., assembly 700) according to certain embodiments of the present invention. More specifically, FIG. 9 shows a multi-strip (two or more) shape-memory element 908. Illustratively, element 908 is shown as comprising three twisting strip-elements 910-1, 910-2, and 910-3 bundled together. Each element 910 is similar to shape-memory element 108 (FIGS. 1–3). However, different elements 910 can have different SMA compositions and mechanical properties. FIG. 10 shows a sectional shape-memory coil-element 1008 comprising four coil sections 1010-1–1010-4, each having a different SMA composition and mechanical properties. FIG. 11 shows a multi-coil shape-memory element 1108 illustratively comprising two shape-memory coil-elements 1110-1 and 1110-2, one inside the other and each having a different SMA composition and mechanical properties.

Different modes of operation may be implemented for communication systems employing driver/antenna assemblies of the present invention. For example, system 100 of FIG. 1 can be configured to operate in a continuous feedback mode, during which the azimuth angle of antenna 102 is continuously adjusted in real time to maintain optimal signal strength. This mode may be useful, for example, when antenna 102 is employed for communication with a mobile station. Depending on the location of (direction to) the mobile station, system 100 dynamically adjusts the azimuth angle of antenna 102 for optimal signal reception. Alternatively, system 100 can be configured to operate in an open-loop mode, during which control circuit 114 steers antenna 102 independent of the received signal strength. This feature may be useful, for example, if it is desired to reduce the number of remote stations accessing a particular base station that is over capacity by temporarily diverting part of the communication traffic to a different base station.

In one embodiment, a temperature-dependent driver of the present invention is configured with an element similar to one of elements 808, 908, 1008, and 1108, which element is designed to have a substantially linear dependence of the shape-restoring force on the current passing through the element within specified current and ambient temperature ranges. As a result, the angle of rotation of the corresponding steerable antenna becomes a linear function of the current. As can be appreciated by one skilled in the art, this linearity significantly simplifies the circuitry for the corresponding control circuit (analogous to control circuit 114 of system 100), e.g., for implementing the above-mentioned open-loop mode. In addition, orientation of the antenna coupled to such a linear shape-memory element can be determined (monitored) very straightforwardly by observing the current.

In another embodiment, a temperature-dependent driver of the present invention is configured with a two-state shape-memory element. As known in the art, material (typically an SMA alloy) of the two-state shape-memory element is formulated and treated to "remember" two different shapes (states), a low-temperature shape and a high-temperature shape. As a result, the two-state shape-memory element adopts the low-temperature shape upon cooling and the high-temperature shape upon heating, thereby providing a bi-directional actuator even without the use of a bias spring. Consequently, in a temperature-dependent driver having a two-state shape-memory element, a bias spring is optional.

While this invention has been described with reference to illustrative embodiments, this description is not intended to be construed in a limiting sense. Differently shaped and configured shape-memory elements and/or bias springs can be used without departing from the principle of the invention. In certain embodiments, instead of a bias spring, a second, separately controlled shape-memory element can be used, e.g., spring 418 of FIG. 4 may be a second shape-memory element, where the memorized shape of shape-memory element 418 corresponds to the antenna orientation shown in FIG. 5A. In operation, only one of the shape memory elements might be heated at a time. Although the present invention was described in reference to shape-memory elements fabricated using SMA alloys, different shape-memory materials, e.g., shape-memory polymers may also be used. A different heater may be used for temperature regulation of a shape-memory element in addition to or instead of resistive heating. A control circuit analogous to control circuit 114 may be implemented in an integrated circuit and combined with an antenna package, e.g., mounted on support plate 704 or included into antenna 702. Various modifications of the described embodiments, as well as other embodiments of the invention, which are apparent to persons skilled in the art to which the invention pertains are deemed to lie within the principle and scope of the invention as expressed in the following claims.

What is claimed is:

1. An apparatus for controlling orientation of an antenna, comprising:

a shape-memory element mechanically coupled between the antenna and a mounting structure;

a bias spring mechanically coupled between the antenna and the mounting structure and configured to oppose a force applied to the antenna by the shape-memory element; and a control circuit electrically coupled to the shape-memory element, wherein:

the control circuit is designed to control temperature of the shape-memory element; and in response to a change in the temperature, the shape-memory element changes shape, which changes the orientation of the antenna relative to the mounting structure.

2. The apparatus of claim 1, wherein the control circuit controls temperature of the shape-memory element based on strength of a signal received from the antenna.

3. The apparatus of claim 1, wherein the control circuit changes the temperature of the shape-memory element by passing current through said element.

4. The apparatus of claim 3, wherein a shape-restoring force generated by the shape-memory element depends substantially linearly on the amount of current passing through said element.

5. The apparatus of claim 1, wherein the shape-memory element is fabricated using a shape-memory alloy (SMA).

6. The apparatus of claim 5, wherein:

the shape-memory element comprises a plurality of segments; and at least two segments are fabricated using different SMA compositions.

7. The apparatus of claim 1, wherein the shape-memory element is a two-state shape-memory element, wherein said element adopts (i) a first shape at temperatures below a first temperature and (ii) a second shape at temperatures above a second temperature.

8. The apparatus of claim 1, further comprising first and second shape-memory elements, wherein:

the first shape-memory element changes an azimuth angle of the antenna relative to the mounting structure as a function of temperature of the first shape-memory element; and the second shape-memory element changes a tilt angle of the antenna relative to the mounting structure as a function of temperature of the second shape-memory element.

9. The apparatus of claim 1, wherein the shape-memory element is adapted to change the orientation of the antenna without changing shape of the antenna.

10. A communication system, comprising:

a steerable antenna;

a shape-memory element mechanically coupled between the antenna and a mounting structure;

a bias spring mechanically coupled between the antenna and the mounting structure and configured to oppose a force applied to the antenna by the shape-memory element; and a control circuit electrically coupled to the shape-memory element, wherein:

the control circuit is designed to control temperature of the shape-memory element; and in response to a change in the temperature, the shape-memory element changes shape, which changes the orientation of the antenna relative to the mounting structure.

11. The system of claim 10, wherein the control circuit controls temperature of the shape-memory element based on strength of a signal received from the antenna.

12. The system of claim 10, wherein the shape-memory element is adapted to change the orientation of the antenna without changing shape of the antenna.

13. The system of claim 10, further comprising first and second shape-memory elements, wherein:

the first shape-memory element changes an azimuth angle of the antenna relative to the mounting structure as a function of temperature of the first shape-memory element; and the second shape-memory element changes a tilt angle of the antenna relative to the mounting structure as a function of temperature of the second shape-memory element.

14. A method of controlling orientation of an antenna, comprising changing temperature of a shape-memory element, wherein:

the shape-memory element is mechanically coupled between the antenna and a mounting structure;

a bias spring is mechanically coupled between the antenna and the mounting structure and configured to oppose a force applied to the antenna by the shape-memory element; and in response to a change in the temperature, the shape-memory element changes shape, which changes the orientation of the antenna relative to the mounting structure.

15. The system of claim 14, wherein the temperature of the shape-memory element is changed based on strength of a signal received from the antenna.

16. The method of claim 14, further comprising fixing the antenna at a selected orientation.

17. The method of claim 14, wherein changing the temperature comprises passing current through the shape-memory element.

18. The method of claim 14, further comprising:

changing an azimuth angle of the antenna with respect to the mounting structure as a function of temperature of a first shape-memory element; and changing a tilt angle of the antenna with respect to the mounting structure as a function of temperature of a second shape-memory element.

19. The method of claim 14, wherein the shape-memory element changes the orientation of the antenna without changing shape of the antenna.

20. An apparatus for controlling orientation of an antenna, comprising:

a shape-memory element mechanically coupled between the antenna and a mounting structure;

a control circuit electrically coupled to the shape-memory element, wherein:

the control circuit is designed to control temperature of the shape-memory element; and in response to a change in the temperature, the shape-memory element changes shape, which changes the orientation of the antenna relative to the mounting structure; and first and second shape-memory elements, wherein:

the first shape-memory element changes an azimuth angle of the antenna relative to the mounting structure as a function of temperature of the first shape-memory element; and the second shape-memory element changes a tilt angle of the antenna relative to the mounting structure as a function of temperature of the second shape-memory element.

21. A communication system, comprising:

a steerable antenna;

a shape-memory element mechanically coupled between the antenna and a mounting structure;

a control circuit electrically coupled to the shape-memory element, wherein:

the control circuit is designed to control temperature of the shape-memory element; and in response to a change in the temperature, the shape-memory element changes shape, which changes the orientation of the antenna relative to the mounting structure; and first and second shape-memory elements, wherein:

the first shape-memory element changes an azimuth angle of the antenna relative to the mounting structure as a function of temperature of the first shape-memory element; and the second shape-memory element changes a tilt angle of the antenna relative to the mounting structure as a function of temperature of the second shape-memory element.

22. A method of controlling orientation of an antenna, comprising:

changing temperature of a shape-memory element, wherein:

the shape-memory element is mechanically coupled between the antenna and a mounting structure; and in response to a change in the temperature, the shape-memory element changes shape, which changes the orientation of the antenna relative to the mounting structure;

changing an azimuth angle of the antenna with respect to the mounting structure as a function of temperature of a first shape-memory element; and changing a tilt angle of the antenna with respect to the mounting structure as a function of temperature of a second shape-memory element.

* * * * *